US005153399A

United States Patent [19]

Schaffer et al.

[11] Patent Number: 5,153,399

[45] Date of Patent: Oct. 6, 1992

[54] ROTARY PUFFER SWITCH

[75] Inventors: John S. Schaffer, Tinley Park; Naresh J. Malaviya, Lombard, both of Ill.

[73] Assignee: G&W Electric Company, Blue Island, Ill.

[21] Appl. No.: 606,332

[22] Filed: Nov. 6, 1990

[51] Int. Cl.[5] ..... H01H 33/70

[52] U.S. Cl. ..... 200/148 R; 200/148 H; 200/150 C; 200/11 TC

[58] Field of Search ..... 200/11 TC, 148 A, 148 H, 200/150 C, 150 F, 150 L, 150 G, 148 R

[56] References Cited

U.S. PATENT DOCUMENTS

| | | | |
|---|---|---|---|
| 2,100,753 | 11/1937 | Schofield et al. | 200/150 C |
| 4,268,890 | 5/1981 | Silbermann | 361/335 |
| 4,342,890 | 8/1982 | Graf | 200/148 A |
| 4,357,508 | 11/1982 | Werner | 200/148 H |
| 4,510,360 | 4/1985 | Golub | 200/151 |
| 4,523,253 | 6/1985 | Grunberg et al. | 361/335 |
| 4,659,886 | 4/1987 | Olsen et al. | 200/148 R |
| 4,675,481 | 6/1987 | Markowski et al. | 200/144 R |
| 4,791,530 | 12/1988 | Kalvaitis et al. | 361/331 |
| 4,803,319 | 2/1989 | Bernard et al. | 200/147 A |
| 5,021,615 | 6/1991 | Muench et al. | 200/11 TC |

FOREIGN PATENT DOCUMENTS 0171352 2/1986 European Pat. Off. .

OTHER PUBLICATIONS

Siemens 8DJ10 Ring Main Units-Catalog HA 45;1-1986.

*Primary Examiner*—J. R. Scott

*Attorney, Agent, or Firm*—Laff, Whitesel, Conte & Saret

[57] ABSTRACT

A puffer switch has a cylindrical shell filled with an electrically insulating gas, such as sulphur hexafluoride. A plurality of spaced parallel plates cooperating with the shell for defining a separate compression chamber or volume for each phase of an electrical power circuit that is to be switched. Located in each volume is at least one set of contacts which are subject to arcing as the contacts open or close. A movable contact in each of the sets of contacts has an associated impeller blade which is mounted to rotate with the movable contact and to sweep through the volume for compressing insulating gas in front of the impeller blade. A nozzle associated with the impeller blade directs the compressed insulating gas onto the set of contacts at a point where the arc is possible. The switch is assembled in a low cost manner by supporting spaced parallel plates defining the volumes between them as a slip-in unit which fits into a shell. A thermosetting plastic is used for parts which become hot. A lower cost thermoplastic is used for most parts which do not become as hot.

48 Claims, 8 Drawing Sheets

FIG. 3
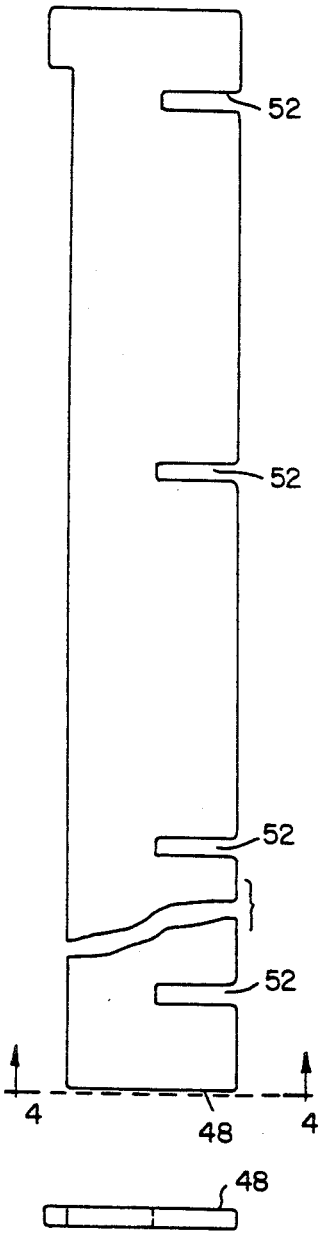
FIG. 4
FIG. 9
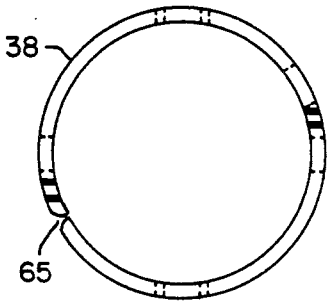
FIG. 7
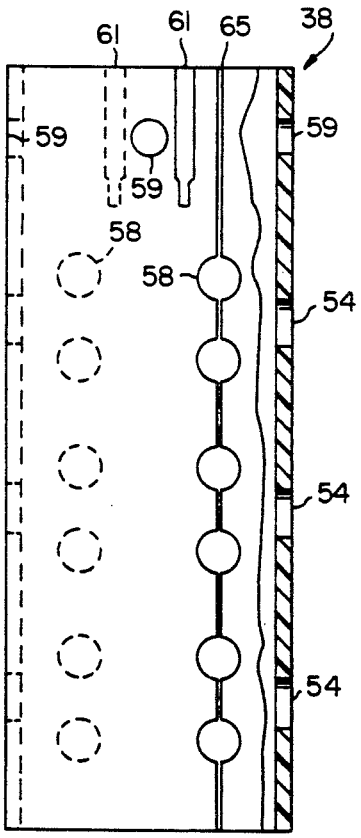
FIG. 8
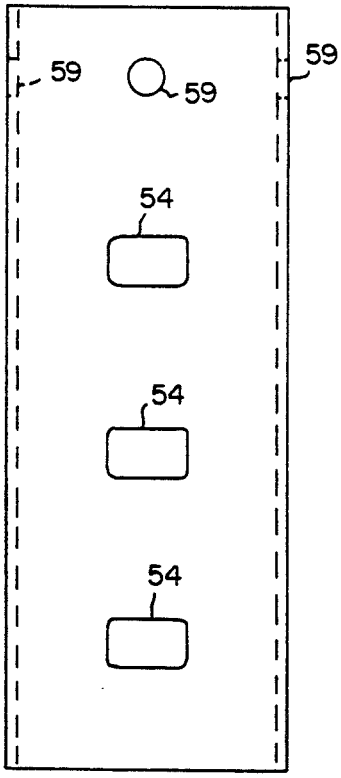

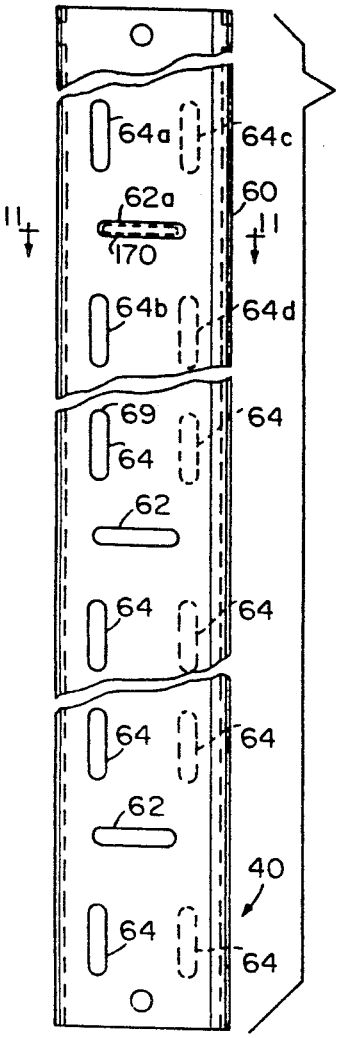
FIG. 10
FIG. 15
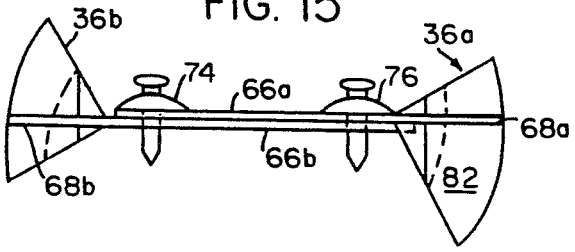
FIG. 12
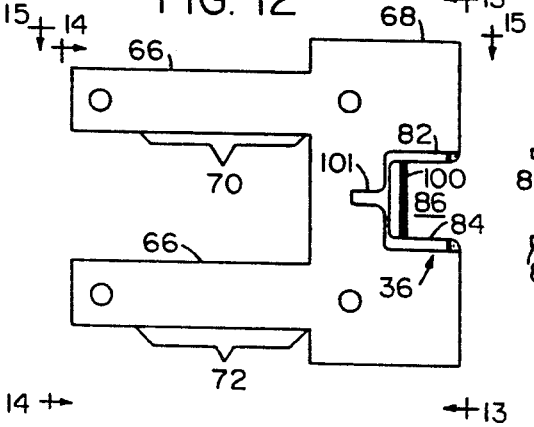
FIG. 13
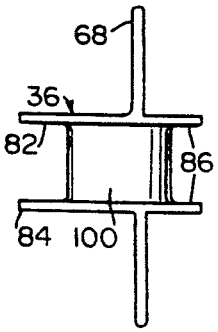
FIG. 5
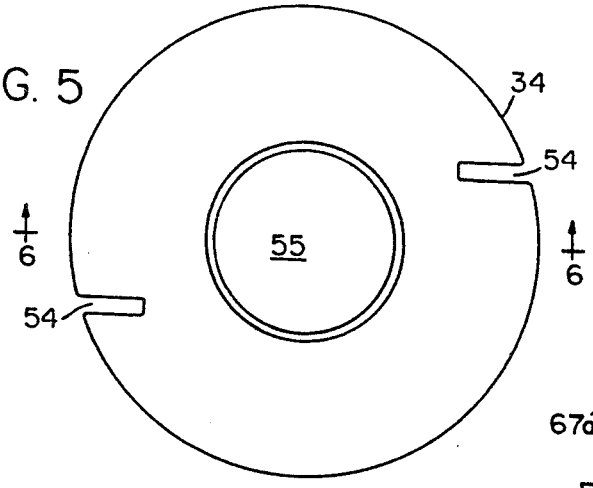
FIG. 11
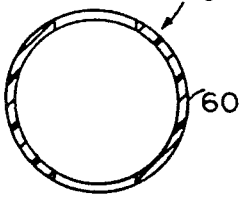
FIG. 6
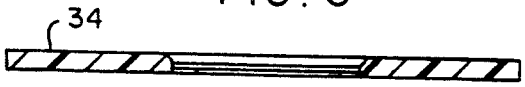
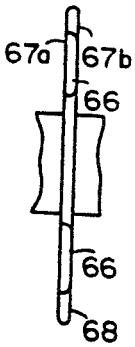
FIG. 14

FIG. 21
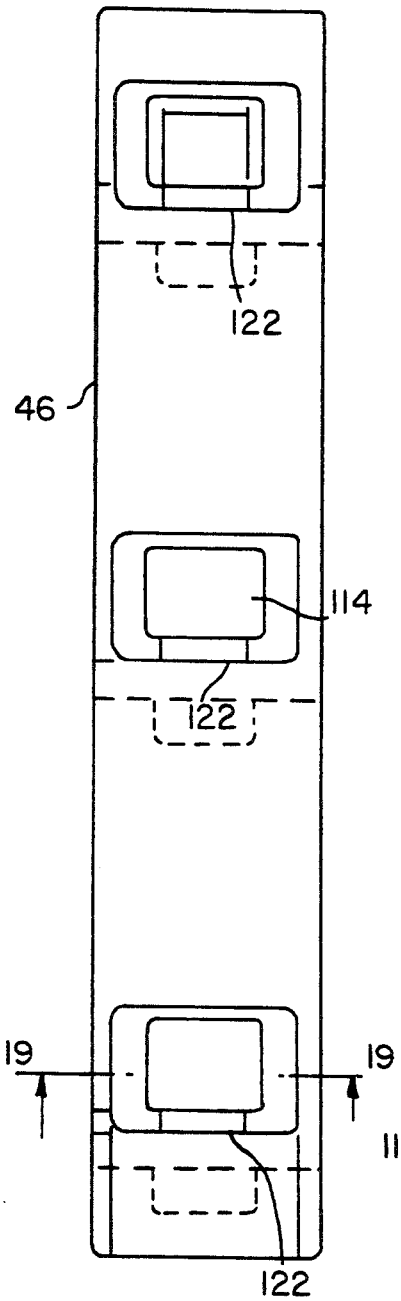
FIG. 22
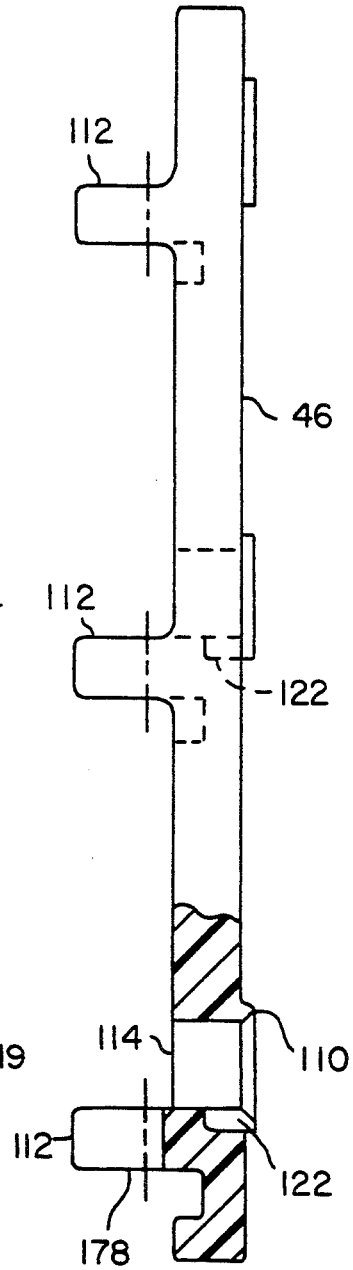
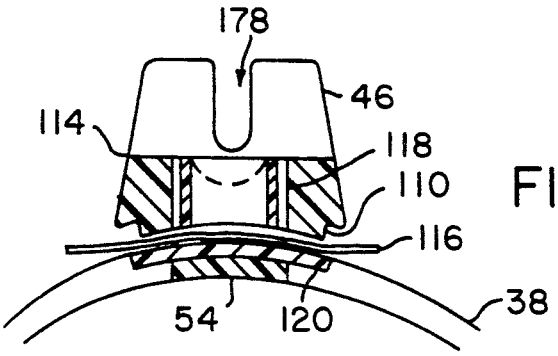
FIG. 23

ROTARY PUFFER SWITCH

BACKGROUND OF THE INVENTION

This invention relates to gas filled puffer switches and more particularly to rotary puffer switches that are easier to manufacture in a low cost manner and without sacrifice of performance characteristics.

The prior art includes the following U.S. Pat. Nos. 2,757,261; 3,214,550; 3,749,869; 3,947,650; 4,268,890; 4,484,047; 4,490,594; 4,523,253; 4,527,029; 4,659,886; European Patents: 0,171,352; 0,214,083; West German Patents: 1,290,223; 2,333,895; PCT application No. 89/11746; and Siemens 8DJ10 Ring Main Units.

In general, a puffer switch is a gas filled (usually high voltage) device which contains contacts that might be subject to arcing or corona discharge when they open or close. Such arcing can cause the contacts to erode and perhaps to disintegrate over time. In some atmospheres, the arc might cause an explosion. Therefore, a known practice is to fill the device with an inert, electrically insulating gas which quenches the arcing. As the switch moves its contacts in an arc-causing motion, the gas is compressed. A jet or nozzle is positioned so that at the proper moment during contact movement, a draft or blast of the compressed gas is directed toward the location of the arc in order to extinguish it.

Once an arc has formed, it is extremely difficult to extinguish until the arc current is substantially reduced. In alternating current (AC) systems, the line current is reduced to zero twice during each AC cycle. As the current approaches zero, the stream of insulating gas cools and deionizes the gas in the arc zone, and may mechanically disrupt the ionized path. Once the arc has been initially extinguished, the cooling and deionizing effect of the gas stream rapidly increases the dielectric strength of the gas in the arc zone, thereby preventing re-ignition of the arc.

Sulphur hexafluoride (SF6) is a gas which is often used in such gas filled switches. Sulphur hexafluoride (SF6) is a chemically and physiologically inert, non-flammable gas which has arc-quenching capability. If a draft of SF6 is blown through the area where an arc occurs, even at low velocities, the arc-quenching effectiveness is greatly multiplied as compared to the effectiveness of the same gas in a still air condition. Also, the interrupting ability of the gas is improved by increasing the pressure of the gas in the switch chamber and therefore, the velocity of the draft of gas.

Most of the prior art puffer switches were simple devices having a plunger which moved longitudinally into or out of contact with a set of stationary contacts. This type of structure was inherently limited as to size and as to the number, combination, or sequence of contacts that could be opened or closed without great sophistication or expense. A rotary puffer switch is more flexible since a large number, combination, and sequence of openings and closings may be built into the switch. However, the prior art rotary puffer switches were more complicated, expensive to build, and difficult to assemble. One problem with these known gas filled rotary switches has been that they required highly complex molded and machined piece parts. Also, the mechanism for compressing the gas and for directing a puff or draft of the gas onto the arc area has not always produced the draft as efficiently as it could have produced it.

OBJECTS AND SUMMARY OF THE INVENTION

Accordingly, an object of the invention is to provide new and improved rotary puffer switches. Here an object is to provide a simplified assembly of relatively low cost components using low cost tooling. In this connection, an object is to provide a design which uses the lower cost of either thermoplastic or thermosetting plastic materials depending upon the material characteristics which are necessary for a given job.

Another object of the invention is to provide rotary puffer switches largely assembled from simple interlocking which do not require highly complex molded piece parts. Another object of the invention is to avoid highly complex molded pieces requiring complex manufacturing tooling.

Still another object of the invention is to provide new and improved ways of compressing the inert, insulating gas within the switch in response to rotary movement of the switch contacts. In particular, an object is to provide an improved nozzle for directing the compressed gas over an extended length of the arc, thus improving its quenching capabilities.

Yet another object of the invention is to provide a general purpose rotary switch that may have different combinations of contacts built into it in order to provide a great variety of structures for performing different switching functions.

In keeping with an aspect of the invention, these and other objects are accomplished by a slip-in assembly of inter-locking parts which snap together to form a rotational framework that may be inserted into a shell. The slip-in framework may be made of low cost parts that may be assembled to provide many different optional configurations. The self-locking feature avoids use of metal fasteners which are found in other devices. These metal fasteners could cause corona to form at randomly located points, which might eventually lead to a dielectric failure.

The framework also provides a mechanical flexibility which absorbs the impact forces of opening or closing the contacts. A controlled and reduced clearance between the various parts eliminates much of the sealing which has heretofore been required to contain gas in the puffer chamber or between contact assemblies associated with different electrical phases. This elimination of a need for tight sealing minimizes operating energy losses and thereby reduces the amount of actuating energy that would otherwise be required. In addition, the inventive rotary gas switch design enables different and multiple configurations of contact break points to be actuated during a single operation. For example, in a preferred embodiment of the invention, each rotating contact simultaneously disengages from two fixed contacts, thus providing two break points per phase, instead of a single break point per phase as provided in typical puffer switches. This results in a higher reignition voltage after current zero and gives an improved interrupt capability, as compared to the interrupt capability when there is only a single set of break contacts. Alternatively, contacts may be arranged to close or open at differing points of rotation during operation of the switch.

This invention may employ thermosetting materials for supporting the contacts, since such materials must not deform responsive to the high temperatures associated with contacts heated by conduction of fault current especially when in a preheated state from conducting load current. However, less expensive thermoplastic material may be used for the shell, framework and other parts where the higher temperatures are not encountered. Thus, the inventive framework construction provides a means for integrating the more expensive thermosetting contact support materials with the less expensive thermoplastic components which do not require the higher temperature limits, for an overall cost reduction.

BRIEF DESCRIPTION OF THE DRAWINGS

A preferred embodiment of the invention is shown in the attached drawings, wherein:

FIG. 3 is an elevational view of a phase barrier support part;

FIG. 4 is an end view of FIG. 3, taken along line 4—4, thereof;

FIG. 5 is a plan view of a phase barrier separation plate; 4 FIG. 6 is a cross-section taken along line 6—6 of FIG. 5;

FIGS. 7 and 8 are two side elevations (taken at a 90 degree rotation relative to each other) of a shell used in the inventive switch for receiving a slip-in unit;

FIG. 9 is a top plan view of the shell of FIGS. 7, 8;

FIG. 10 is a side elevation of a rotor shaft;

FIG. 11 is a cross-section taken along line 11—11 of FIG. 10;

FIG. 12 is a side elevation of an impeller blade or plate;

FIG. 13 is an end view of FIG. 12 taken along line 13—13 thereof;

FIG. 14 is an opposite end view of FIG. 12 taken along line 14—14, thereof;

FIG. 15 is a top plan view of two of the impeller plates fastened together, one impeller plate being taken along line 15—15 of FIG. 12;

FIG. 21 is a rear elevation view of a stationary contact support plate;

FIG. 22 is a side elevation view of the stationary contact support plate of FIG. 21, shown partially in section;

FIG. 23 is a cross section view of the stationary contact support plate of FIGS. 21–22, including a portion of the shell;

DETAILED DESCRIPTION OF THE PREFERRED EMBODIMENT

Figure 1:
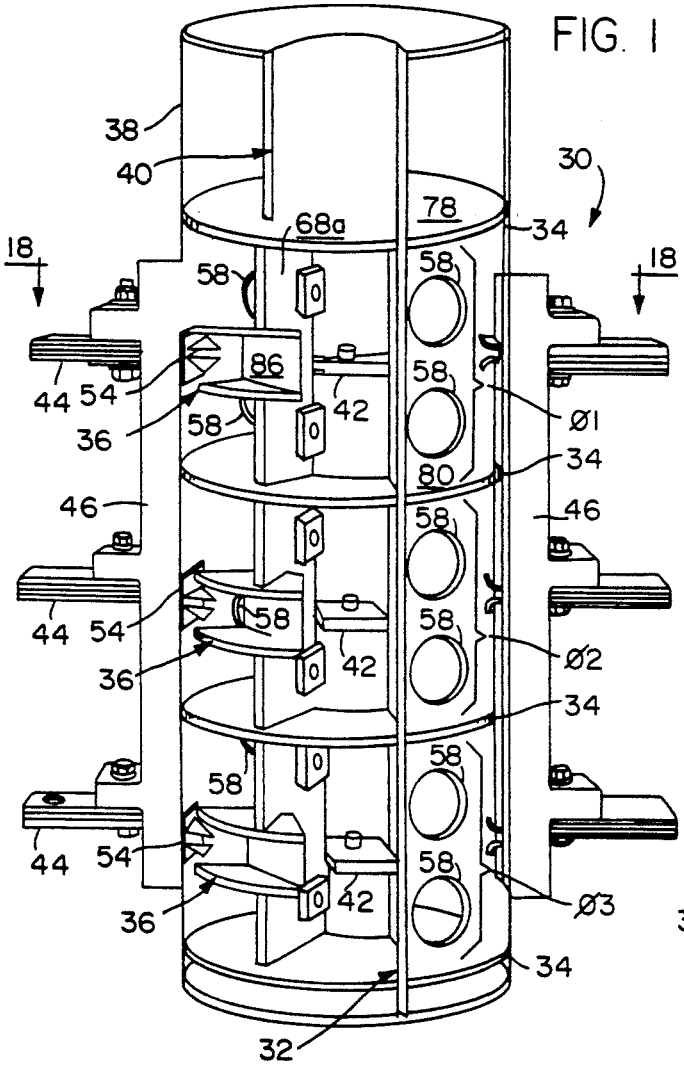
FIG. 1 is a perspective view of a completely assembled rotary puffer switch in an open contact position.
Figure 2:
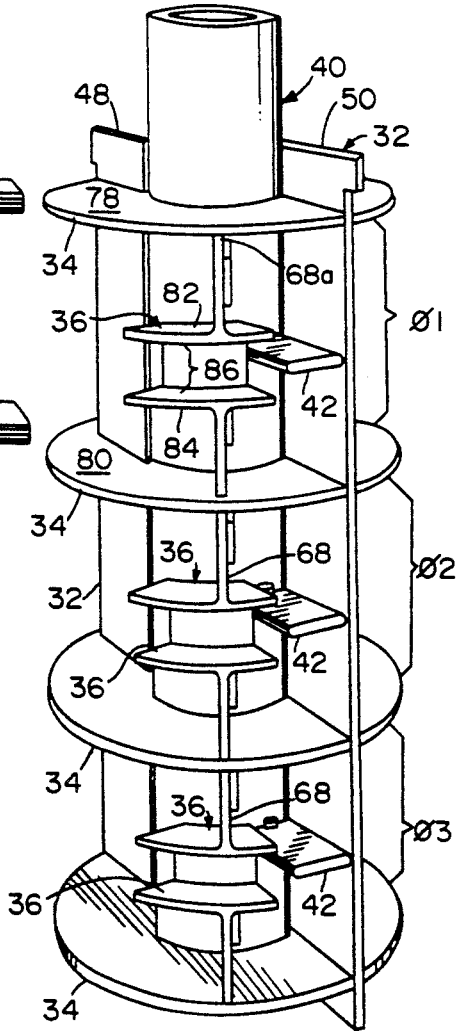
FIG. 2 is a perspective view of a slip-in rotor unit.

The complete structure of the inventive puffer switch 30 is seen in FIGS. 1 and 2 which show a phase barrier support 32, a plurality of spaced parallel phase barrier separation plates 34, an impeller blade or plate with nozzle 36 between each pair of phase barrier plates 34, a shell 38, a rotor assembly 40, a set of moving contacts 42 and associated stationary cont,acts 44 for each phase, and a pair of stationary contact supports 46.

The stator support 32 (FIGS. 3, 4, 16) comprises a pair of elongated stator support plates 48, 50, each with a plurality of notches 52 formed at selected locations therein. The notches 52 receive complementary notches 54 on four notched disks 34 (FIGS. 5, 6) which form the phase barrier plates. The disks 34 separate the rotor into three phase areas $\phi 1$, $\phi 2$, and $\phi 3$, as shown in the particular example of FIG. 2, which correspond to the three phases of high electrical voltages which are transmitted over power lines. Each disk 34 has a central hole 55, which are aligned when the disks 34 are snapped into the stator supports 48, 50. Therefore, when notches 54 on the four disks 34 are secured in place in the notches 52 of supports 48, 50, there is a slip-in assembly (FIG. 2) which may slide axially into cylindrical shell 38 (FIGS. 1, 7, 8, 16). The disks 34 are the phase barrier plates which, together with stator support plates 48, 50 rotor tube 40 and shell 38, form a compression chamber or volume in which gas may be entrapped.

The shell 38 (FIGS. 7–9) is preferably made of a transparent plastic material which enables the people who are operating the energized switch to visibly confirm open contact conditions in switch tanks incorporating windows. It also permits assembly personnel to verify its proper manufacture. The shell 38 includes a series of horizontal holes 54 for receiving stationary contacts 44 (FIG. 1). For each stationary contact 44, the stationary contact supports 46 have a respective locator boss 110 (FIGS. 17–19) which partially extends into the holes 54. The locator bosses 110 have a shape corresponding to that of the holes 54 to permit the supports 46, and contacts 44 to be precisely located with respect to the remainder of the switch. The shell 38 also has a series of vertical holes 58 which, in effect, provide intake and exhaust ports for the insulating gas contained in the switch to pass into the compression chamber or volumes formed by the phase barrier plates and cooperating parts. A hole or plurality of holes 59 and slots 61 may be provided at one end of the shell 38 in order to couple it to any suitable operating device for turning the rotor assembly 40, such as a rotary, spring loaded operator (not shown).

The transparent shell 38 receives a slip-in unit 63 (FIG. 16) comprising a plurality of the barrier phase plates 34 held in place by stationary support members 48, 50. The shell 38 may include a longitudinal slot 65 (FIGS. 7, 9, 16) which allows the shell to expand slightly in order to receive the slip-in unit 63. However, shell 38 is preferably constructed to the required dimensions so that a slot 65 is not needed. In some embodiments, the gap may be sealed after the slip-in unit 63 is in place. In other embodiments, the shell 38 may be heated and shrunk to fit over the disks 34 and supports 48, 50. Alternatively, the shell 38 may be constructed from slightly undersized commercially available tubing by heating the shell and stretching it to the required size.

The shell 38 is secured between a pair of stationary contact supports 46, 46, (FIGS. 1 and 16–20). Since the stationary contacts 44 may become very hot, these supports 46 are preferably made of a thermosetting plastic. Most of the remaining parts do not become as hot, and, therefore, may be made of less expensive thermoplastic material.

As seen most clearly in FIGS. 21–23, the stationary contact support plates 46 include a plurality of stationary contact mounting stubs 112, and corresponding holes 114 to receive the stationary contacts 44. The support plates 46 are attached to the outside surface of shell 38. In order to ensure precise positioning of the stationary contacts 44 with respect to the remainder of the switch, a plurality of raised bosses 110 are provided on the inside surface of the support plates. The raised bosses 110 extend a small distance into the holes 54 of shell 38. A relieved ledge 120 may be provided in each of holes 54 to provide an abutting surface for the raised bosses 110. Stationary contact support plates 46 are preferably attached to shell 38 using any appropriate attachment means. For example, an adhesive 116 may be provided to secure the support plates to the shell 38, and prohibit migration of the support plate with respect to the shell. Mechanical fasteners (not shown) could also be used.

Holes 114 and mounting stubs 112 may be lined with a heat-resistant barrier sleeve 118 to protect support plates 46 from exposure to high temperatures which may be presented by contacts 44. This would permit support plates 46 to be constructed of a less expensive thermoplastic material. It would also allow integration of the shell 38 and support plates 46 into one part. Sleeve 118 may be constructed of an appropriate thermosetting material or another material having high resistance to damage by heat. While sleeve 118 is described herein as "lining" holes 114 and mounting stubs 112, sleeve 118 may instead be mechanically associated with contacts 44, thereby forming an external lining for the contacts.

The rotor assembly 40 (FIGS. 2, 10–13, 16–20) comprises a tubular shaft 60 (FIG. 10) having a plurality of holes 62, 64 formed therein and mounted for rotation. Each of the horizontal holes 62 receives and supports a moving contact 42 which, after assembly, is affixed to rotor tube 60 and rotates therewith. Contacts 42 may be a suitable copper bar or other appropriate conductive material.

A heat-resistant barrier sleeve or lining material 170 (FIG. 10) similar to sleeve 118 could also be applied to the holes 62 in rotor tube 60 for supporting the moving contacts 42. Alternately, the sleeve 170 could be mechanically associated with the moving contacts 42 at and around the location where the contacts 42 pass through holes 62, thereby forming an external lining for those contacts. Such a sleeve 170 would permit the rotor tube to be made of a less expensive thermoplastic material.

Figure 16:
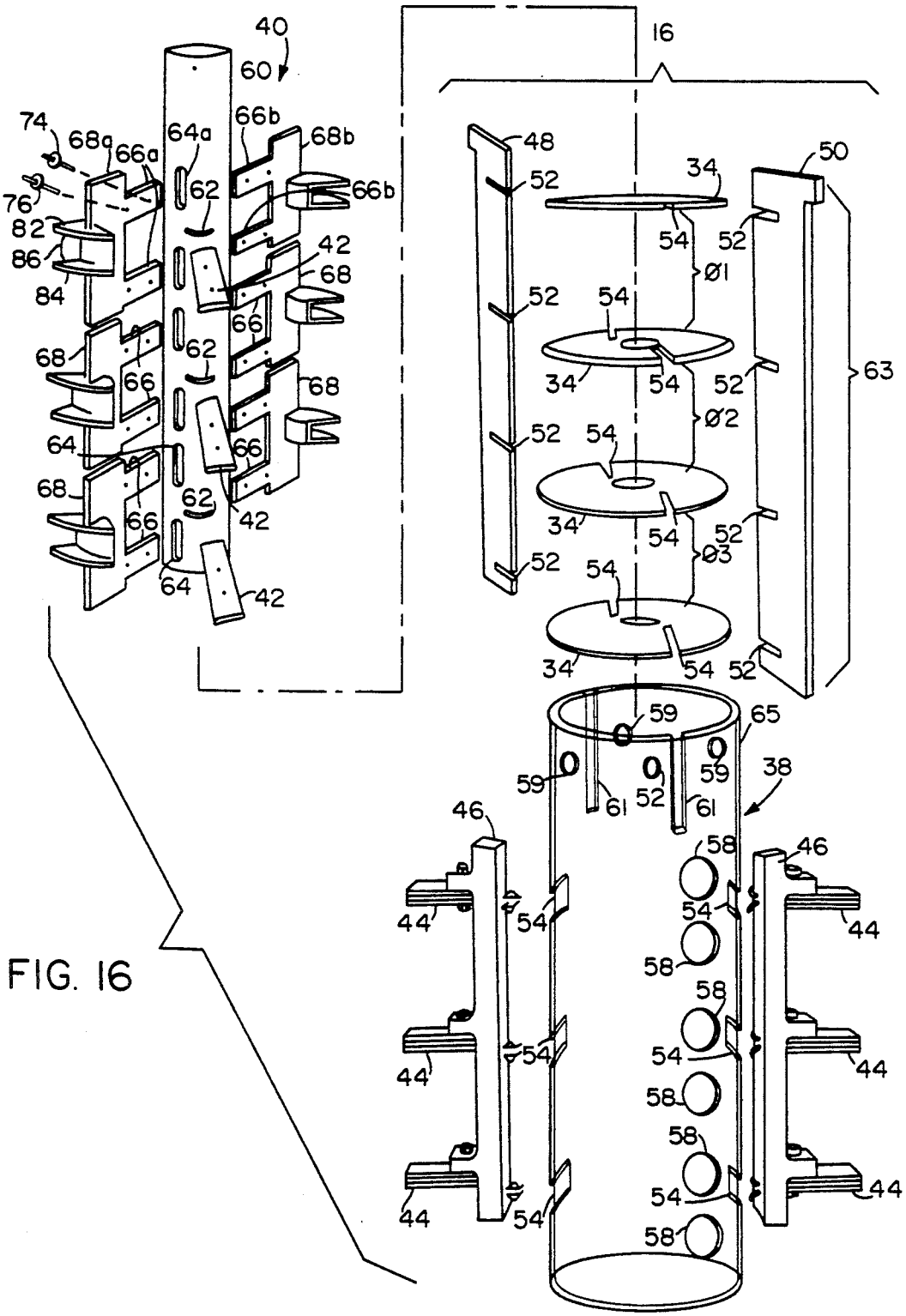
FIG. 16 is an exploded view which shows how the inventive switch is assembled.

As shown in FIG. 10, all slots are horizontally aligned so that all contacts will open and close simultaneously. If, for example, one horizontal slot 62*a* (FIG. 10) should have been positioned to the right of the position disclosed here, the contact in that slot 62*a* would close before the contacts in the other slots 62 close. In an embodiment where the contact break points have been relocated, a similar relocation of the nozzle and impeller blade would be desireable so that the nozzle and blade would deliver a draft of insulating ga toward the region where an arc is likely to form. Each of the vertical holes 64 receives and supports an arm 66 on an impeller blade or plate 68 (FIGS. 10–13). More particularly, as best seen in FIG. 16, arms 66*a*, 66*a*, 66*b*, 66*b*, pass through holes 64*a*, 64*b*, and another, but diametrically opposed, set of holes 64*c*, 64*d* (FIG. 10) on the opposite side of the rotor shaft 60. The rotor shaft 60, itself, occupies the space 70, 72 (FIG. 12) on the impeller blade. The arms 66*a*, 66*a*, 66*b*, 66*b* of opposed impeller blades 68*a*, 68*b* (FIG. 15) come into face contact and are fastened together by insulating fasteners 74, 76, such as rivets or other appropriate fasteners.

As best shown in FIGS. 10 and 14, the holes 64 in rotor shaft 60 for accommodating impeller arms 66 are formed as slots having "half-round" ends 69 (FIG. 10). Each of the impeller arms 66 has a cross-section matching a vertically sliced half of one of holes 64. Thus, the arms 66 are formed with "quarter-round" corners 67*a* (FIG. 14) on their upper face, and with sharp right-angle corners 67*b* on their lower face. When two opposed impeller blades 68 are properly assembled together, the right-angle corners 67*b* of each of the arms are adjacent, and only the "quarter-round" corners 67*a* are exposed. Thus, the "quarter-round" corners 67*a* combine to form a cross section matching the "half-round" cross-section 69 of holes 64, and the individual impeller blades may be successfully inserted in the holes. When two impeller blades are improperly assembled, at least two of the sharp right-angle corners 67*b* are exposed, so that the combined cross section does not correspond to that of holes 64, and the blades may not be inserted in the holes.

The insulating gas nozzle 82–86 is seen in FIGS. 1, 2, 12, 13, 15–17. A compression chamber or volume for each of the phases $\phi 1$–$\phi 3$ (FIG. 1) is in an isolated gas-filled area defined by upper and lower phase barrier separation plates 34, as at 78, 80 (FIG. 1, 2), for example. The stator support plates 48, 50 cooperate with phase barrier plates 34, rotor tube 60, and shell 38 to form a chamber or volume in which the insulating gas may be compressed. Rotatably mounted to swing through the volume of $\phi 1$ which is between the barrier plates 78, 80 are impeller blades or plates 68*a*, 68*b*.

Mounted on and moving with the impeller blade 68*a* (FIGS. 12–17) are upper and lower baffle plates 82, 84 and a base plate 100, which define between them a gas passageway or nozzle 86. The base plate 100 is preferably supported by a flange 101. The moving contact 42 and stationary contacts 44 have a geometrical relationship which is such that any arc which may occur as the contacts open is positioned in alignment within nozzle 86 (best seen in FIG. 19). That is, at the time when an arc may occur, upper baffle plate 82 is above and lower baffle plate 84 is below the potential arc; or, stated another way, the arc is in the center of the draft of gas expelled through the passageway formed by nozzle 86, as the gas is compressed by the movement of the impeller blade or plate.

As best seen in FIGS. 14–15, nozzle 36 preferably extends asymmetrically above and below the plate portion 68 of the impeller. In addition to directing insulating gas at the appropriate location for extinguishing the arc, the asymmetrical nozzle arrangement also prevents installation of a moving contact 42 on the rotor tube 60 if the corresponding pair of impeller blades 68 has been improperly assembled. Holes 62, 64 in the rotor tube 60 for the impellers 68 and the movable contacts 42 specifically locate the impellers and the movable contacts in a predefined angular orientation with respect to one another. If one of the pair of impeller blades 68 is reversed by 180 degrees (i.e. installed "upside-down"), the longer portion of both nozzles will extend on the same side of the impeller blade. The base plate 100 and support flange 101 of the incorrectly installed impeller will extend into the region reserved for the movable contact 42, and will interfere with the contact 42 in case an attempt is made to insert it.

Figure 24:
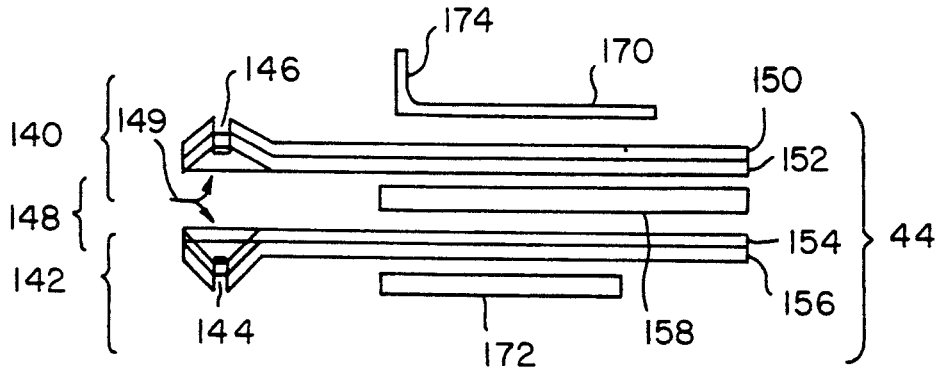
FIG. 24 is an enlarged side elevation view of a stationary contact.

The construction of the stationary contacts 44 is best seen in FIG. 24. Each stationary contact preferably comprises an upper substantially planar portion 140 and a lower substantially planar portion 142 separated by a spacer 158. Spacer 158 provides a small gap 148 to receive the moving contact 42. The gap is preferably slightly smaller than the thickness of the moving contact 42 so that the moving contact is securely gripped by the stationary contact portions 140, 142 when inserted therebetween. The upper and lower portions 140, 142 of the stationary contact thus elastically deform a small distance as the moving contact 42 is inserted. Each of the contact portions 140, 142 has a section 146 which is bent or curved away from gap 148. The bent sections 146 form an angled chute 149 for receiving the moving contact 42. The chute permits the moving contact 42 to enter the gap 148 between the upper and lower portions 140, 142 of the stationary contact 44 even if the moving contact is slightly misaligned with the gap.

The upper and lower contact portions 140, 142 are preferably constructed of a plurality of laminated conductive metal plates. As shown in FIG. 24, the upper portion 140 is constructed of a first plate 150 and a second plate 152. The lower portion 142 is constructed of a first plate 154 and a second plate 156. While the upper and lower contact portions 140, 142 are each shown herein as having two laminations, they could be constructed having any appropriate number of laminations required to provide the required current-carrying and heat sinking capacity. Alternately, each of the contact portions 140, 142 could be constructed of a single piece of conductive material.

As best seen in FIG. 24, in order to control the flexure of the stationary contacts 44, two clamping plates 170, 172 are applied adjacent the stationary contacts at a predefined distance from the end which engages the moving contact. These clamping plates 170, 172 use the same mounting hardware as the stationary contacts 44. One clamping plate 170 contains an anchoring hook 174 which engages a notch 122 in the stationary contact support plate 46. This anchoring hook 174 ensures that the stationary contact 44 is initially properly located, and subsequently always retained in its proper position with respect to stationary contact support plate 46.

Figure 17:
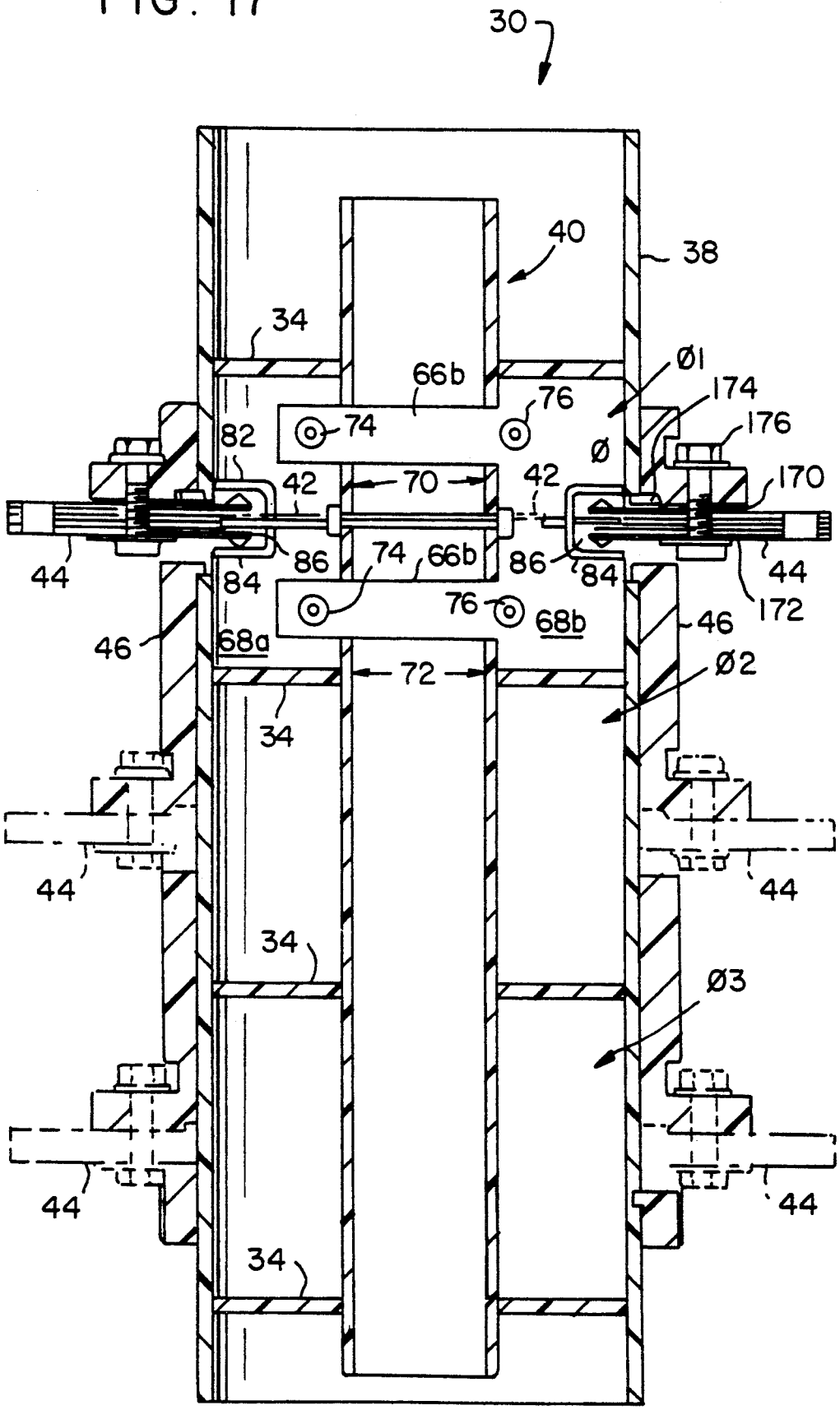
FIG. 17 is a side elevation, partly in cross section, showing the assembled switch, with a set of contacts within the nozzle.

As best seen in FIG. 17, the stationary contact 44 extends into the cylindrical housing 38 through aperture 114 in the stationary contact support plate 46, and through aperture 54 in the housing 38. An appropriate fastener 176, such as a nut and bolt set, extends downward through a slot 178 (FIG. 23) in stationary support plate and through apertures (not shown) in contact 44 and clamping plates 170, 172. During operation of the switch, large forces may be placed on contact 44 to displace it from its normal position. Although the fastener 176 secures the contact 44 and clamping plates 170, 172 together, because slot 178 has an open end, the fastener alone may not be entirely effective in securing these components to the stationary contact support plate 46. Therefore, clamping plate 170 is provided with an anchoring hook 174 which extends upward into a small relieved region 122 (FIGS. 17, 21, 22) on the inside face of stationary contact support plate 46. By interfering with plate 46, anchoring hook 174 prevents the fixed contact 44 from being displaced from its normal position.

Figure 25:
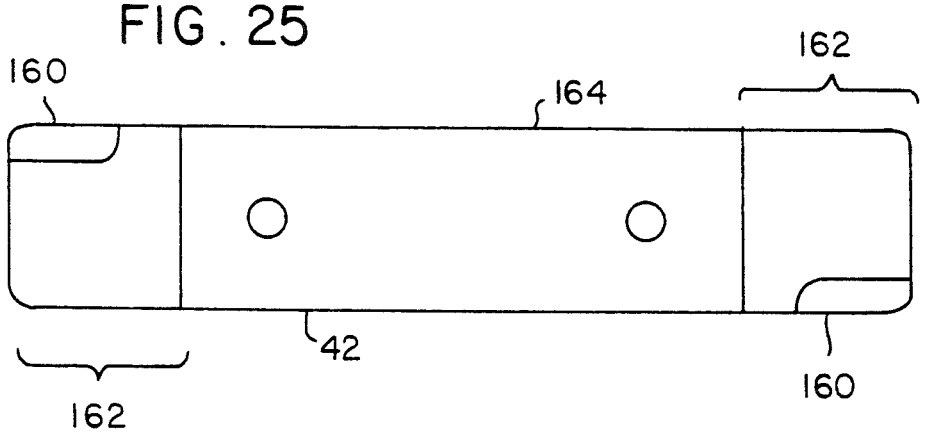
FIG. 25 is a top plan view of a moving contact.
Figure 26:
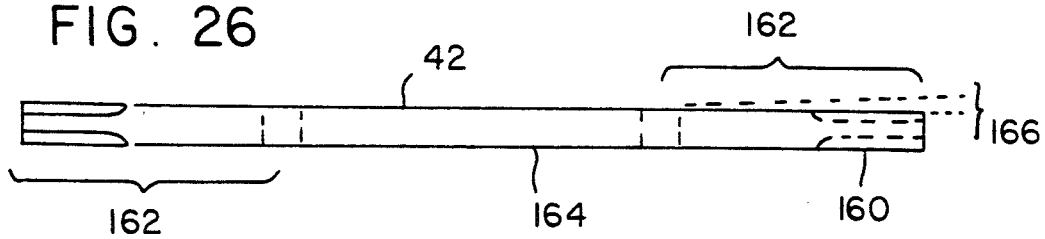
FIG. 26 is a side elevation view of the moving contact of FIG. 25.
Figure 26A:
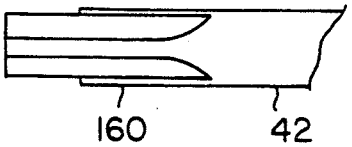
FIG. 26A is an enlarged side elevation view of a wedge area on the moving contact of FIGS. 25–26.

As best seen in FIGS. 25, 26, and 26A, the moving contact 42 is formed as a generally blade-shaped structure of a conductive material such as copper. In order to reduce the resistance between the moving and fixed contacts when engaged, the moving contact 42 may be coated or plated with an appropriate highly-conductive material such as silver. The moving contact 42 has a substantially flat section 164 in its center. The moving contact 42 preferably has a slightly tapered engagement section 162 at each end of the contact for engaging a stationary contact 44. The taper accommodates the elastic deformation of the upper and lower portions 140, 142 of the stationary contact as the moving contact is inserted therebetween.

The shape of the tapered engagement section 162 is preferably selected so that the mechanical load placed upon the moving contact is approximately equally distributed throughout the length of the tapered engagement section 162. The equally distributed mechanical load advantageously produces a relatively large contact surface between the stationary contact and the moving contact, thereby minimizing localized regions of contact which may reduce current carrying ability, cause undesirable heating of the contacts, or produce other undesirable behavior. For the type of stationary contacts 44 described herein, a linear taper is acceptable. As best seen in FIG. 26, the thickness of the moving contact 42 is reduced from a nominal thickness proportionally according to the distance from the beginning of the tapered engagement section 162. The maximum reduction in thickness, shown as distance 166, is found at the extreme tip of the contact 42, and is preferably in the range of 0.005 inches to 0.100 inches for a moving contact having a nominal thickness in the center region 164 of approximately 0.2 inches.

The moving contact 42 preferably also has a wedge section 160 at the leading edge (that is, the edge of the moving contact that first meets the stationary contact upon insertion) of each tapered engagement section 162. The wedge section 160 provides a slightly beveled leading edge so that the moving contact may easily slide against the stationary contact, rather than presenting a sharp corner to the stationary contact which may tend to increase wear. The wedge section 160 also provides improved tolerance of any misalignment which may occur between the moving contact 42 with respect to the stationary contacts 44.

While the stationary contacts 44 and moving contacts 42 have been described having specific configurations, the shape and size of these contacts may be varied according to the requirements of the application in which the switch is used. In particular, the size of the contacts may be increased to provide greater current-carrying capacity. The size of the spacer 158 between the upper and lower portions 140, 142 of the stationary contacts may be varied to accommodate larger or smaller moving contacts 42 as required.

Figure 20:
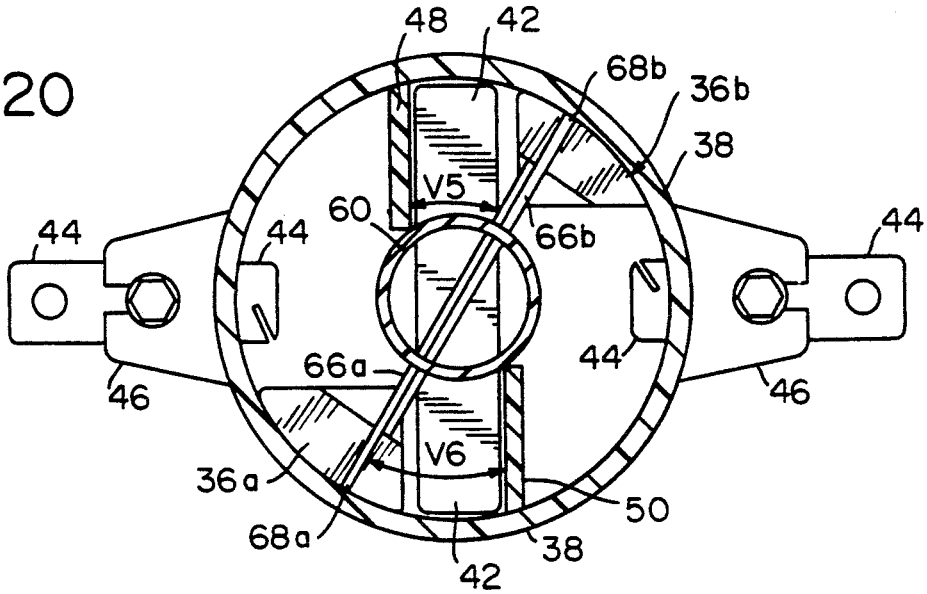
FIGS. 18–20 are three stop motion views taken along line 18—18 of FIG. 1 showing the operation of the inventive switch.
Figure 19:
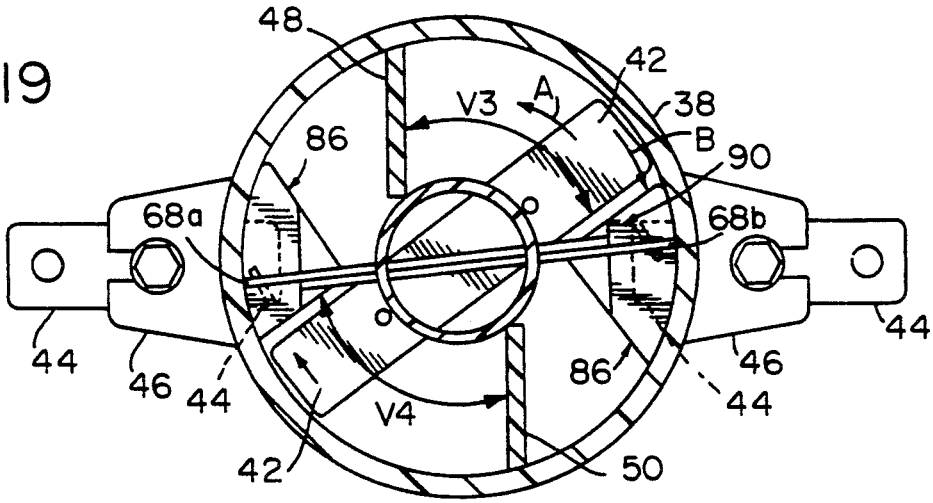
Figure 18:
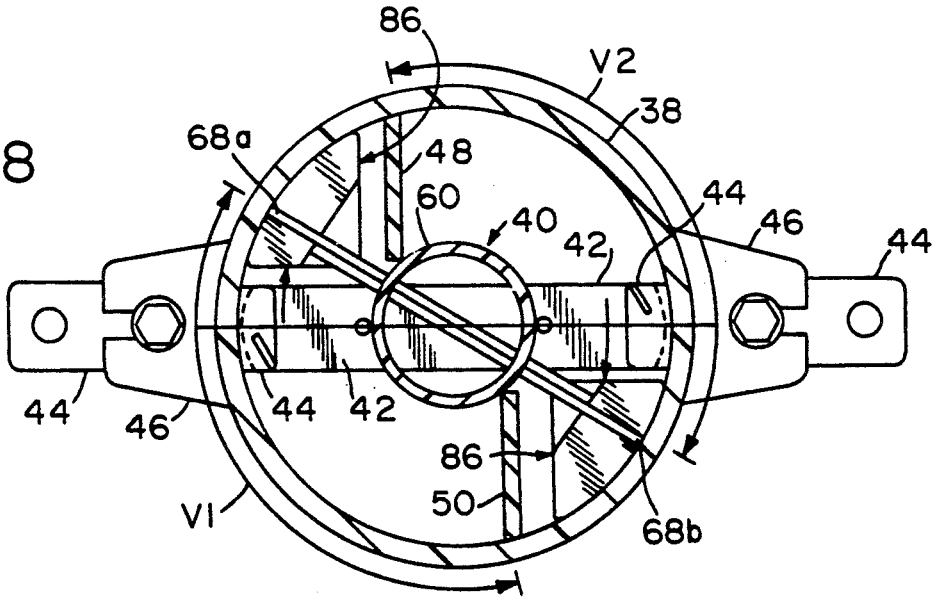

The operation of the inventive puffer switch (contact opening) is best illustrated in FIGS. 18–20. Mounted on and turning with the rotor shaft 60 of the rotor assembly 40 are a set of moving contacts 42, one contact for each of the three phases $\phi 1$–$\phi 3$ (FIGS. 1, 2) of the electric power circuit that is to be switched. That is, a moving contact 42 is positioned within each of the three phase areas $\phi 1$, $\phi 2$, $\phi 3$ (FIGS. 1, 2). When the rotor is turned to one rotary position (FIG. 18), the moving contacts 42 engage the stationary contacts 44 and the circuits controlled thereby are closed. When the rotor assembly 40 is turned to another position (FIG. 20) the moving contacts 42 are positioned away from the stationary contacts 44 and the controlled circuits are open.

More particularly, FIG. 18 shows the impeller blades or plates 68*a*, 68*b* in a closed contact position where the moving contact 42 has engaged the stationary contacts 44. Non-compressed insulating gas fills the compression chamber or volume V1 (FIG. 18) defined by phase plates 78, 80 (FIG. 1), stator support plate 50, rotor tube 60 and impeller plate 68*a*. Likewise, gas fills a similar volume V2 on an opposite side of the switch.

FIG. 19 shows the impeller blade or plate 68 as it is in the process of rotating or swinging in direction A toward a fully opened contact position in which movable contact 42 is positioned far from stationary contacts 44. As the impeller blade 68 moves (FIG. 19) in the direction of arrow A, the circuit opens and an arc may be formed in zone 90. As the gas is compressed from volumes V1, V2, down to volumes V4, V3 the primary avenues for the gas to escape from the compression chambers or volumes is through the nozzles 86. Therefore, during the rotary motion of impeller blade 86, volumes V1, and V2 have been reduced to volumes V3, V4, and compressed insulating gas is forced in direction B through nozzle 86 to impinge on to extinguish the arc in zone 90. With a continued movement of the impeller blade 68 in direction A, the gas is further compressed between the impeller blade 68 and the gas barriers formed by stationary or stator supports 48, 50, and upper and lower phase barrier plates 78, 80 (FIG. 1) and continues to flow through nozzle 86 to extinguish the arc. Since the switch does not contain seals but instead relies upon controlled clearances, a secondary avenue for a limited amount of pressurized gas to escape is through the clearance area between the mating surfaces forming the compression chamber.

The amount of gas which is delivered to the arc depends upon providing a sufficiently large initial volume and small final volume for the compression chamber and upon providing a direction and size for the nozzle 86 to direct a draft of gas onto the arc. Since the upper and lower baffle plates 82, 84 and base plate 100 guide and direct the draft of compressed gas directly over a substantial length of the arc column rather than at a singular point, the inventive switch provides substantially improved interrupt performance over that attained with a nozzle of shorter length approximating the thickness of the impeller blade itself.

FIG. 20 shows the end of the stroke where moving contacts 22 are fully displaced from stationary contacts 44 and volumes V3, V4, have closed to V5, V6, completing the compression of gas within the volumes or compression chambers.

The holes 58 formed in the shell 38 permit interchange of gas between the compression chambers and the exterior gas containment vessel (not shown) in which the inventive switch is located.

It has been found that, with the inventive design, there is no need for tightly sealing the impeller blade 68 against either the phase barrier separation plates 34 or the wall of the shell 38. Therefore, with a reasonably close physical relationship, the puffer switch operation is adequate to blow a draft of insulating gas across the area of contact closure to extinguish the arc formed when the contacts open and minimize the distance and duration of arcing sustained when the contacts close.

Those who are skilled in the art will readily perceive how to modify the invention. Therefore, the appended claims are to be construed to cover all equivalent structures which fall within the true scope and spirit of the invention.

The invention claimed is:

1. A rotary puffer switch comprising at least one set of contacts having a moving contact and a stationary contact which are subject to arcing, a shell containing an electrically insulating gas, a plurality of spaced parallel barrier plates for cooperating with said shell to define a separate volume associated with at least one of said sets of contacts, rotor means for supporting and rotating said movable contact in order to open or close the set of contacts, an impeller means mounted to rotate with said movable contact and to sweep through said volume associated with said set of contacts, said impeller means for compressing any of said gas in front of said impeller means within said volume, and nozzle means associated with said impeller for directing said compressed gas over a distance between said set of contacts where an arc is possible.

2. The puffer switch of claim 1 wherein there are at least three of said spaced parallel barrier plates for defining at least two of said volumes between them, at least two of said sets of contacts, each of said sets of contacts being individually associated with a corresponding one of said volumes, and means for supporting said plates in said spaced parallel relationship.

3. The puffer switch of claim 1 wherein there are at least four of said spaced parallel barrier plates for defining at least three of said volumes between them, at least three of said sets of contacts, each of said sets of contacts being individually associated with a corresponding one of said volumes, and stator means for supporting said barrier plates in said spaced parallel relationship, said parallel barrier plates and support means forming a slip-in unit fitting into said shell, whereby said three sets of contacts may switch each of three phases of an electric power circuit.

4. The puffer switch of claim 1 wherein said nozzle means comprises a pair of spaced parallel baffle plates mounted on said impeller blade perpendicular to said blade and parallel to said parallel barrier plates, said baffle plates defining said nozzle between them, said nozzle being oriented to sweep at least toward said other set of stationary contacts as said impeller blade sweeps through said volume.

5. The puffer switch of claim 4 wherein there are at least four of said spaced parallel barrier plates for defining at least three of said volumes between them, at least three of said sets of contacts, each of said sets of contacts being individually associated with a corresponding one of said volumes, and means for supporting said barrier plates in said spaced parallel relationship, said parallel barrier plates and support means forming a slip-in unit fitting into said shell, whereby said three sets of contacts may switch each of three phases of an electric power circuit.

6. The puffer switch of claim 5 and means forming an opening in said shell for admitting gas into said volume when contacts are in a closed position, said opening being closed by said impeller blade as it sweeps through said volume whereby said gas compresses in front of said plate for forcing said compressed gas through said nozzle.

7. The puffer switch of claim 5 and means forming a pressure differential by said impeller blade as it sweeps through said volume whereby said gas compresses in front of said impeller blade for forcing said compressed gas through said nozzle.

8. The puffer switch of claim 1 and means forming an opening in said shell for admitting gas into said volume when contacts are in a closed position, said opening being closed by said impeller blade as said impeller means sweeps through said volume whereby said gas compresses in front of said blade for forcing said compressed gas through said nozzle.

9. The puffer switch of claim 1 and means forming a pressure differential by said impeller blade as said impeller means sweeps through said volume whereby said gas compresses in front of said impeller blade for forcing said compressed gas through said nozzle.

10. The puffer switch of claim 1 wherein said impeller means comprises a blade extending substantially between said shell and said parallel barrier plates.

11. The puffer switch of claim 1 wherein said parallel barrier plates and support means form a slip-in unit fitting into said shell.

12. The puffer switch of claim 11 wherein said slip-in unit further includes said rotor means and said impeller means.

13. The puffer switch of claim 11 wherein said parallel barrier plates and support means are notched for engagement with one another.

14. The puffer switch of claim 13 wherein said slip-in unit further includes said rotor means and said impeller means, said rotor means having notches to receive said impeller means.

15. The puffer switch of claim 1 wherein said nozzle means comprises a channel formed substantially perpendicular to said impeller means.

16. The puffer switch of claim 15 wherein said channel is operatively connected to said impeller means to rotate therewith.

17. The puffer switch of claim 1 further comprising means supporting said stationary contact; said shell further comprising means for receiving said stationary contact.

18. The puffer switch of claim 17 wherein said stationary contact support means comprises means for engaging said stationary contact receiving means of said shell.

19. The puffer switch of claim 18 further comprising adhesive means for attaching said stationary contact support means to said shell.

20. The puffer switch of claim 17 further comprising means for thermally protecting said stationary contact receiving means of said shell.

21. The puffer switch of claim 20 said thermally protecting means is constructed from a thermosetting material.

22. The puffer switch of claim 17 further comprising means for thermally protecting at least a portion of said stationary contact support means.

23. The puffer switch of claim 22 said thermally protecting means is constructed from a thermosetting material

24. The puffer switch of claim 17 further comprising means applied to said stationary contact for thermally protecting said stationary contact receiving means of said shell and at least a portion of said stationary contact supporting means.

25. The puffer switch of claim 24 wherein said thermally protecting means is constructed from a thermosetting material.

26. The switch of claim 17 further comprising means for retaining said stationary contact in a predefined position comprising:

at least one retaining plate having a member for engaging a portion of said stationary contact support means; and fastener means for securing said retaining plate to said stationary contact.

27. The puffer switch of claim 1 wherein said rotor means further comprises means for receiving said moving contacts and means for thermally protecting said moving contact receiving means.

28. The puffer switch of claim 27 wherein said thermally protecting means is constructed from a thermosetting material.

29. The puffer switch of claim 1 further comprising means applied to said rotary contact for thermally protecting said rotor means.

30. The puffer switch of claim 29 wherein said thermally protecting means is constructed form a thermosetting material.

31. The puffer switch of claim 1 wherein said moving contact comprises a region for engaging said stationary contact, said moving contact having a tapered profile in said region.

32. The puffer switch of claim 1 wherein said moving contact comprises a region for engaging said stationary contact, said moving contact having a variable thickness in said region.

33. The puffer switch of claim 32, said variable thickness being greatest near an inner portion of said region and said variable thickness being least near a peripheral portion of said region.

34. The puffer switch of claim 32, said region having a first boundary and a second boundary, said thickness varying substantially linearly between said first boundary and said second boundary.

35. The puffer switch of claim 1, said moving contact and said stationary contact touching one another to define a contact region, said moving contact and said stationary contact applying a mechanical force against one another at said contact region, said switch further comprising means for substantially equally distributing said mechanical force throughout said contact region.

36. The puffer switch of claim 1 wherein at least two of said impeller means are mounted on said rotor means in an opposing pair.

37. The puffer switch of claim 1 wherein said impeller means comprises a blade for compressing said insulating gas and arm means for attaching said blade to said rotor means.

38. The puffer switch of claim 37 said rotor means further comprises means for receiving said arm means of said impeller means.

39. The puffer switch of claim 38 wherein at least two of said impeller means are mounted on said rotor means in an opposing pair;

said arm means has a first face and a second face;

said first faces of each of said opposing impeller means are arranged to abut one another; and said arm means extend through said arm receiving means of said rotor means.

40. The puffer switch of claim 38 wherein at least two of said impeller means may be mounted on said rotor means as an opposing pair in a predefined relationship;

said arm receiving means of said rotor means have a predefined shape; and said arm means of said opposing pair of impeller means cooperating to form an external profile matching said shape of said arm receiving means exclusively when disposed in said predefined relationship.

41. The puffer switch of claim 38 wherein at least two of said impeller means may be mounted on said rotor means as an opposing pair in a predefined relationship;

said arm receiving means of said rotor means have a predefined shape; and said arm means of said opposing pair of impeller means cooperating to form an external profile differing from said shape of said arm receiving means whenever disposed in other than said predefined relationship, said differing external profile preventing said pair of impeller means from being mounted on said rotor means.

42. The switch of claim 1 further comprising means applied to said stationary contact for limiting flexure of said stationary contact along at least a portion of said stationary contact.

43. The switch of claim 42 said means for limiting flexure of said stationary contact comprises at least one stiff plate member disposed adjacent to said contact a flex-resisting force to at least a portion of said stationary contact.

44. A puffer switch comprising a plurality of barrier plates for defining at least one volume containing an electrically insulating gas, at least one set of contacts within said volume which is subject to arcing as said contacts open, said set of contacts comprising at least a movable and a stationary contact, rotor means for supporting and rotating said movable contact in order to open or close the set of contacts, thereby creating a condition where arcing is possible, an impeller blade associated with said rotor means in order to rotate with said movable contact and to sweep through said volume as said contacts open or close to compress any of said gas within said volume, and nozzle means mounted on said impeller blade for directing said compressed gas over a distance between said set of contacts where said arc is possible, said nozzle comprising spaced baffles mounted on said impeller blade to define a nozzle passageway perpendicular to said blade and parallel to said barrier plates, said nozzle being oriented to sweep said passageway past said stationary contacts as said impeller blade sweeps through said volume.

45. The puffer switch of claim 44 further comprising stator plate means for supporting four of said barrier plates in a spaced parallel relationship for defining between them three of said volumes, a set of said contacts and an impeller blade being individually associated with and enclosed within each corresponding one of said volumes, each of said volumes being defined by a pair of said parallel barrier plates, one of said impeller blades, and a stator plate means, whereby three sets of contacts are provided for individually switching each of three phases of an electric power circuit.

46. The puffer switch of claim 45 and rotor shaft means for supporting said movable contacts and said impeller blades to sweep toward or away from said stationary contacts, and means associated with said shaft to position individual ones of said contacts and impeller blades relative to each other for providing desired combinations and sequences of switching contact operations.

47. The puffer switch of claim 45 and means made of a thermosetting material associated with and supporting said stationary contacts, and means made of thermoplastic material associated with and supporting parts other than said stationary contacts.

48. The puffer switch of claim 45 and means made of a thermosetting material associated with and supporting parts which become hot during operation, and means made of thermoplastic material associated with and supporting parts other than said parts which become hot during operation.

* * * * *